US005622006A

United States Patent [19]

Collins

[11] Patent Number: 5,622,006

[45] Date of Patent: Apr. 22, 1997

[54] SURFACE MOUNT BI-DIRECTIONAL GATE ASSEMBLY

[75] Inventor: Terence J. Collins, Schaumburg, Ill.

[73] Assignee: General Signal Corporation, Stamford, Conn.

[21] Appl. No.: 541,554

[22] Filed: Oct. 10, 1995

[51] Int. Cl.[6] ..... E05F 1/10

[52] U.S. Cl. ..... 49/386; 16/79

[58] Field of Search ..... 49/386, 326; 16/71, 16/79

[56] References Cited

U.S. PATENT DOCUMENTS

| | | | |
|---|---|---|---|
| 3,280 | 9/1843 | Barton | 16/79 |
| 73,277 | 1/1868 | Adams | 49/326 |
| 171,171 | 12/1875 | Robbins | 16/79 |
| 1,989,908 | 2/1935 | Bolinsack et al. | 49/386 X |
| 4,026,069 | 5/1977 | Bohnett | 49/386 X |
| 5,228,240 | 7/1993 | Barrdero et al. | 49/386 |

FOREIGN PATENT DOCUMENTS

| | | | |
|---|---|---|---|
| 137568 | 4/1985 | European Pat. Off. | 49/326 |

*Primary Examiner*—Kenneth J. Dorner
*Assistant Examiner*—Jerry Redman
*Attorney, Agent, or Firm*—Ohlandt, Greeley, Ruggiero & Perle

[57] ABSTRACT

A bi-directional door for the elderly and handicapped which comprises a support assembly mounted to a floor, a swing gate pivotally mounted about a support shaft in the support assembly, and a controller assembly located within the support assembly. A first bevel gear at the base of the swing gate is positioned for rotation about the support shaft. A second bevel gear, which is controlled by the controller assembly, is coupled to the first bevel gear at a 90 degree angle. Accordingly, when the swing gate is opened and released, the controller assembly controls the rotation of the first and second bevel gears such that the swing gate returns back to a home position at a predetermined rate. In addition, the support assembly includes various ways for adjusting and fine tuning the angular position of the bi-directional door in the support assembly.

11 Claims, 7 Drawing Sheets

SURFACE MOUNT BI-DIRECTIONAL GATE ASSEMBLY

The present invention relates generally to bi-directional gates having a controller assembly for controlling the opening and closing of the gate. More particularly, the present invention relates to a surface mount bi-directional gate assembly wherein the controller assembly is positioned above the surface of the floor to facilitate installation and maintenance thereof and to avoid water damage to the various components of the controller assembly.

BACKGROUND OF THE INVENTION

The transportation provisions of the Americans with Disabilities Act (ADA), 49 CFR Parts 27, 37 and 38, provide the minimum requirements for establishing special access to transportation for individuals with disabilities, such as the elderly or handicapped. The transportation provisions of the ADA state that revolving doors and turnstiles shall not be the only means of passage at an accessible entrance or along an accessible route. In particular, accessible gates designed to facilitate passage by a disabled person shall be provided adjacent to turnstiles or revolving doors at transportation facilities.

The transportation provisions of the ADA require that the floor or ground area within the vicinity of the accessible gate be level and clear, and the hardware required for the entire assembly of the accessible gate be no higher than 48 inches (1220 mm) above the floor. If the accessible gate has a closing mechanism, then the sweep period of the closing mechanism shall be adjusted so that, from an open position of 70 degrees from the closed position, the leading edge of the accessible gate will take at least 3 seconds to move to a point 3 inches (75 mm) from the closed position. In addition, the maximum force for pushing or pulling open an interior hinged gate shall be 5 lbs. (22.2 N).

Consequently, ADA compliant gate assemblies have been developed for use by individuals with disabilities. Generally, such gate assemblies include a controller assembly for controlling the operation of opening and closing the gate for disabled individuals. Existing gate assemblies typically have a controller assembly mounted in the floor so that the upper surface of the controller assembly is flush with or below the surface of the floor. Not only are such existing gate assemblies expensive to install due to their typical encasement within a concrete floor, but they must be installed at locations having plenty of floor space to allow for such sub-flooring encasement thereof. In addition, since the controller assembly is mounted below the surface of the floor, it is subject to possible corrosion due to water seepage into the controllers sub-flooring encasement.

Furthermore, conventional controller assemblies disposed beneath the surface of the floor utilize a Dor-O-Matic™ controller assembly, manufactured by Doro-O-Matic Inc. The Dor-O-Matic controller assembly typically comprises a substantially flat, oblong-shaped controller body and a drive shaft which extends perpendicularly outward from the controller body. These conventional sub-surface controller assemblies are typically disposed horizontal to the surface of the floor. Thereafter, the support shaft of the gate assembly is loosely coupled to the drive shaft of the Dor-O-Matic controller assembly by virtue of the weight of the gate assembly itself. This can cause misalignment of the support shaft and its associated gate with respect to the drive shaft of the Dor-O-Matic due to the support shafts movement within the female coupler used to connect the support shaft to the drive shaft of the Doro-O-Matic. Misalignment of the support shaft is extremely difficult to correct, especially when the controller assembly is encased beneath the surface of a concrete floor by means of a metal or wooden cover plate.

The unique vertically disposed Dor-O-Matic controller assembly which is mounted within the gate post of the gate assembly provides an above-surface controlling mechanism having a minimum footprint. Installation is limited to simple lag bolts which secure the base of the gate post to the floor, thus allowing for fast installation. The gate assembly according to the present invention complies with all ADA requirement concerning a smooth uninterrupted floor surface which negates the possibility of mounting the controller assembly on the surface of the floor. The entire controller assembly is protected against water damage due to it's above-ground location. Adjustments and servicing can be accomplished without requiring access to below floor mounted components. Finally, the angular alignment of the gate assembly with respect to the closed or latched position of the gate in the opposing solenoid driven latching mechanism disposed in the opposing latch post can be readily altered by the disposition of a novel centering plate disposed about the stationary support shaft disposed in the gate post, utilizing a pair of alignment screws disposed therein.

Accordingly, the present invention positions the controller assembly above the surface of the floor while complying with the transportation provisions of the ADA. Thus, by positioning the controller assembly above the floor surface, the gate assembly is easy to install and maintain, and the controller assembly is above the typical water level to avoid water damage.

SUMMARY OF THE INVENTION

The present invention, in brief summary, is a bi-directional gate assembly which comprises a gate and a support assembly mounted substantially perpendicular to a floor. The support assembly comprises a housing, a stationary support shaft vertically disposed within the housing, means for rotating the gate about the stationary support shaft, and a controller assembly disposed within the housing above the surface of the floor. The controller assembly is connected to the means for rotating the gate about the stationary support shaft (e.g., approximately 90° from the closed position of the gate) in such a way as to control the degree of rotation of the gate about the stationary support shaft and to cause the gate to return to its closed position at a predetermined speed (i.e., from an open position of 70° from the closed position, the leading edge of the accessible gate will take at least 3 seconds to move to a point 3 inches from the closed position).

The controller assembly of the present invention is disposed perpendicular to the surface of the floor and comprises a controller housing and a drive shaft extending perpendicular from a side of the controller housing such that it is substantially parallel to the surface of the floor. The controller assembly is coupled to the gate by the drive shaft which is perpendicularly disposed to the controller housing, a stub shaft positioned about the lower end of the drive shaft of the controller assembly for the purpose of coupling the drive shaft to a bevel gear which is disposed about the stub shaft and perpendicular to the stationary support shaft, another bevel gear vertically disposed about the stationary support shaft, meshed with the other bevel gear and coupled to the lower hinge of the gate. The vertically disposed bevel gear is coupled to the lower hinge of the gate by means of a centering plate which is adjustably connected to a threaded extension which is screwed into a horizontal or perpendicular extension disposed about the bottom portion of the lower hinge of the gate. The first and second bevel gears are meshed together so as to couple the gate to the controller assembly. The controller assembly is thus capable of controlling the degree of rotation of the gate about the stationary support shaft and causing the gate to return to its closed position at a predetermined speed. In addition, the first bevel gear and the second bevel gear are positioned perpendicular to each other and have a 1:1 ratio of rotation.

The centering plate is connected to the threaded extension by means of a pair of oppositely disposed centering or alignment screws which are capable of centering the gate at its closed or latched position.

DETAILED DESCRIPTION OF THE PREFERRED EMBODIMENT

A bi-directional gate assembly which comprises a gate having a gate body and at least one hinge and a support assembly mounted substantially perpendicular to a floor. The support assembly preferably comprises: a housing; a stationary support shaft vertically disposed within the housing; means for rotating the gate about the stationary support shaft; and a controller assembly disposed within the housing above the surface of the floor, the controller assembly being connected to the means for rotating the gate about the stationary support shaft in such a way as to control the degree of rotation of the gate about the stationary support shaft and to cause the gate to return to its closed position at a predetermined speed.

The controller assembly comprises a controller housing and a drive shaft extending from a side of the controller housing. The controller housing is disposed perpendicular to the surface of the floor. The controller assembly is coupled to the gate by the drive shaft which is perpendicularly disposed to the controller housing.

The means for rotating the gate about the stationary support shaft comprises: a centering plate which is coupled to the hinge and a first bevel gear which is affixed to the centering plate. The means for rotating the gate about the stationary support shaft further comprises a radial bearing disposed between the inner surface of the hinge and the outer surface of the stationary support shaft. Furthermore, the means for rotating the gate about the stationary support shaft also comprises a threaded extension screw adjustably disposed within a bottom, perpendicular extension to the hinge. The centering plate is connected to the threaded extension screw by means of a pair of alignment screws which are capable of centering the gate at its closed or latched position by adjusting the angular alignment between the first bevel gear and the threaded extension screw.

The controller assembly is connected to the means for rotating the gate about the stationary support shaft by means of a stub shaft coupled to the drive shaft of the controller assembly, and a second bevel gear affixed about the stub shaft, wherein the second bevel gear is meshed in sync with the first bevel gear. The first bevel gear is disposed parallel to the stationary support shaft and the second bevel gear is disposed perpendicular to the stationary support shaft. The first bevel gear and the second bevel gear have a 1:1 ratio of rotation.

Figure 1:
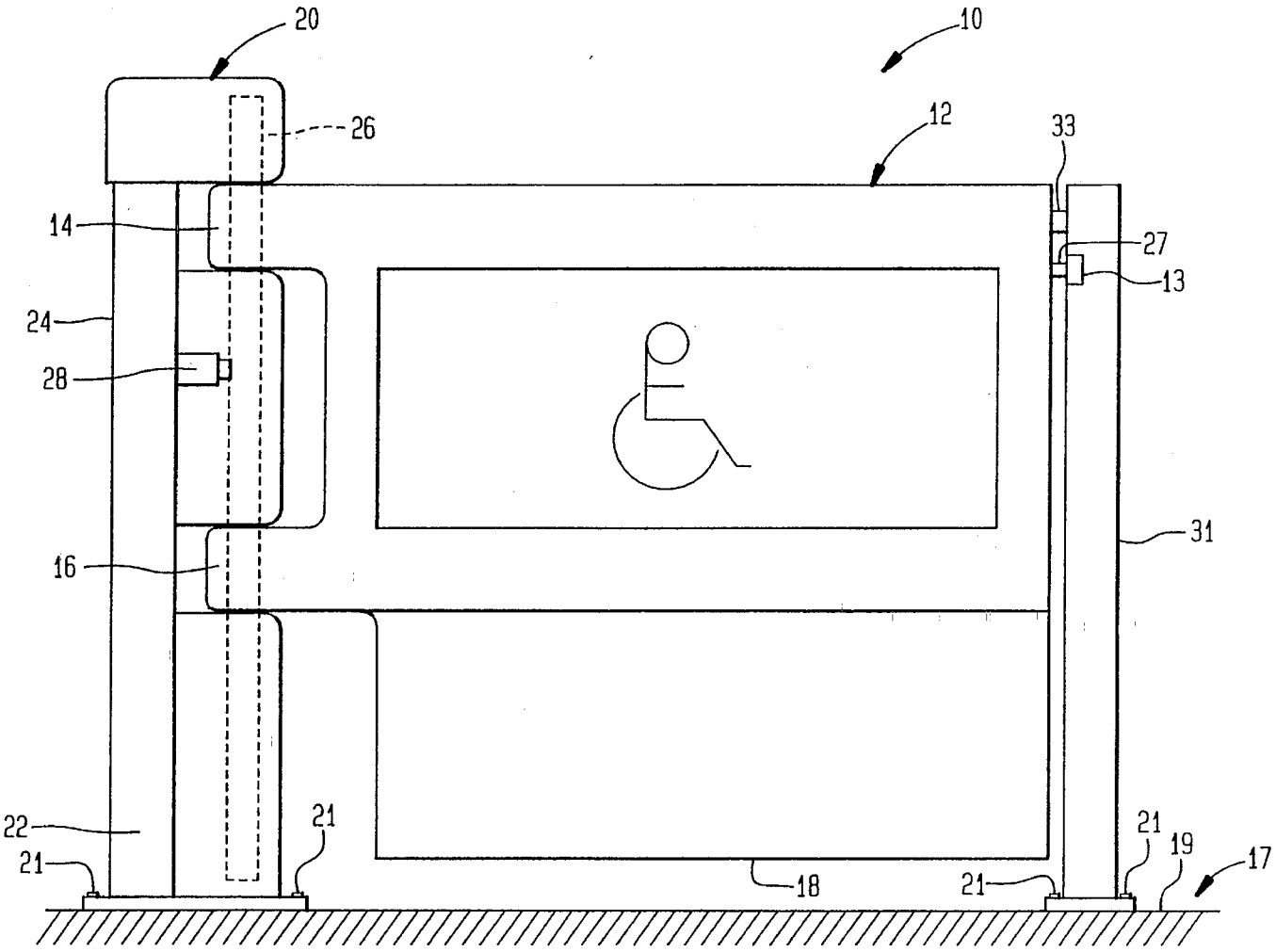
FIG. 1 is a side elevation view of the preferred embodiment of the present invention which generally shows a swing gate positioned on a support assembly.

Referring to the drawings and, in particular, to FIG. 1, there is provided a bi-directional gate assembly of the preferred embodiment which is generally represented by reference numeral 10. Bi-directional gate assembly 10 substantially complies with the transportation provisions of the ADA, and preferably the entire gate assembly is positioned above surface 19 of floor or ground 17.

Referring to FIG. 1, preferred gate assembly 10 comprises a swing gate 12 and a support column or assembly 20. A lower end 22 of support assembly 20 is mounted perpendicular to a floor surface 19 by simple lag bolts 21, thus allowing for fast and unrestricted positioning of support assembly 20. Since lower end 22 of support assembly 20 is the only part of gate assembly 10 that contacts the floor, gate assembly 10 has a minimum footprint and requires very little floor space, since Dor-O-Matic controller assembly 40 is vertically disposed within the support assembly 20 rather than horizontally within floor 17. The support assembly 20 includes an outer housing 24 and a stationary support shaft 26 which is vertically disposed either within or adjacent to housing 24.

Swing gate or gate body 12 is mounted about stationary support shaft 26 at upper and lower gate hinges 14, 16 such that a bottom edge 18 of swing gate 12 clears the floor surface. Radial bearings (15, 17) are disposed between hinges (14, 16) and shaft 26 to provide easy rotation of swing gate 12 about shaft 26. Hinge 14 is mounted and supported by means of load or thrust bearing 46. For the preferred embodiment, swing gate 12 is mounted for 180 degree rotation about support shaft 26. When swing gate 12 pivots to a position at the mid-point between the extremes of its 180 degree rotation, as shown in FIG. 1, swing gate 12 is at its closed position.

Figure 2:
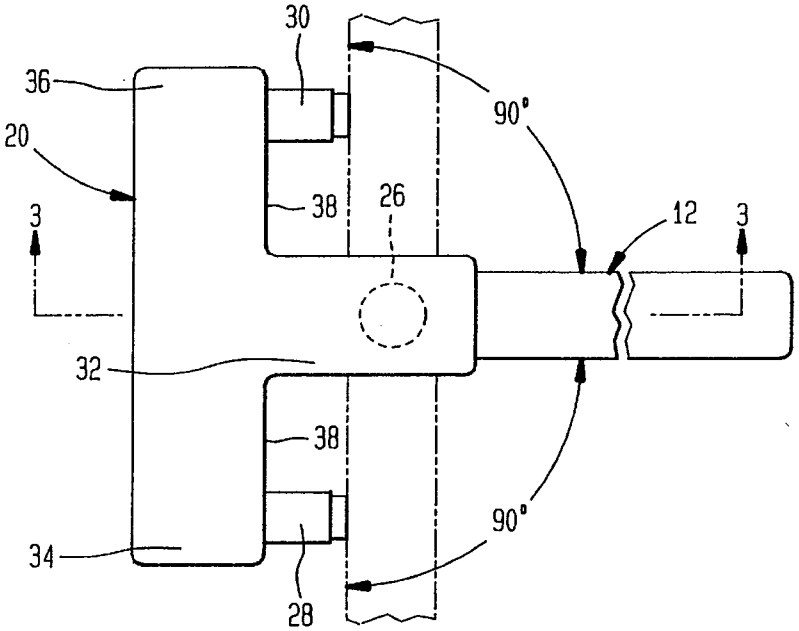
FIG. 2 is a top planar view of the bumper assembly disposed about the support assembly of FIG. 1.

Referring to the preferred embodiment of FIGS. 1 and 2, a pair of bumpers 28, 30 are positioned on the outer surface of support assembly 20 to prevent swing gate 12 from traveling about support shaft 26 more that 90 degrees in either direction from its closed position. As shown in the top planar view of FIG. 2, support assembly 20 is generally a T-shaped structure with a mid-section 32 aligned with swing gate 12 and two arms 34, 36 extending perpendicular to mid-section 32. One end of each bumper 28, 30 is positioned on a common side 38 of arms 34, 36 and an opposing end of each bumper 28, 30 extends in a direction opposite each mounted end such that bumpers 28, 30 are parallel with mid-section 32. When swing gate 12 pivots 90 degrees in either direction from its closed position, a portion of swing gate 12 will abut the opposing end of one bumper. Thus, bumper 28 or bumper 30 will prevent swing gate 12 from rotating beyond a predetermined angular position about support shaft 26.

Figure 3:
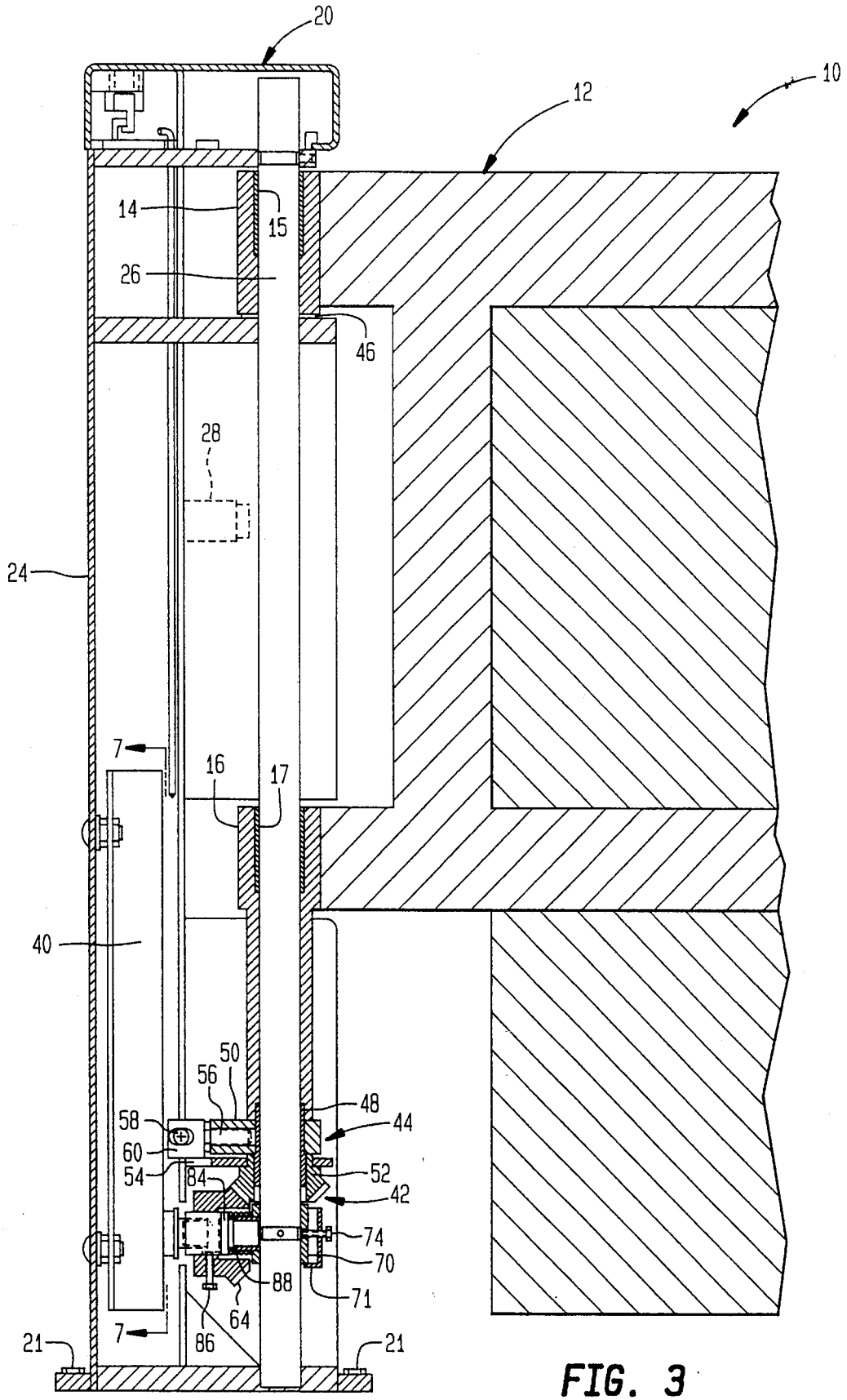
FIG. 3 is a cross-sectional view along line 3—3 of FIG. 2 which schematically depicts the controller assembly according to the present invention.

Referring to FIG. 3, support assembly or gate post 20 of the preferred embodiment includes outer housing 24 and stationary support shaft 26 which is vertically disposed within housing 24. In addition to support shaft 26, support assembly 20 includes a controller assembly 40 (detail of controller assembly 40 shown for sake of clarity in FIGS. 7 and 8), a coupling assembly 42 and a centering or alignment assembly 44 which are capable of movably coupling controller assembly 40 to lower hinge 16 and for aligning the angular radial position of swing gates 12 about support shaft 26 with respect to the latching mechanism 13 disposed in adjacent latching post 31. Latching post 31 comprises a solenoid locking mechanism (not shown) which is capable of electronically opening and closing about latch 27 which is disposed about the end of swing ate 12. As shown in FIG. 3, controller assembly 40 is disposed within housing 24 above the surface of the floor such that the length of controller assembly 40 is perpendicular to the floor surface and parallel to support shaft 26. The upper hinge 14 is supported underneath by a bronze thrust bearing 46, and lower hinge 16 is connected to centering assembly 44. Thus, upper and lower hinges 14, 16 are pivotally mounted for rotation about support shaft 26. For safety reasons, emergency bar 33 is disposed on gate 10 which automatically opens solenoid mechanism 13 when emergency access is required.

Figure 4:
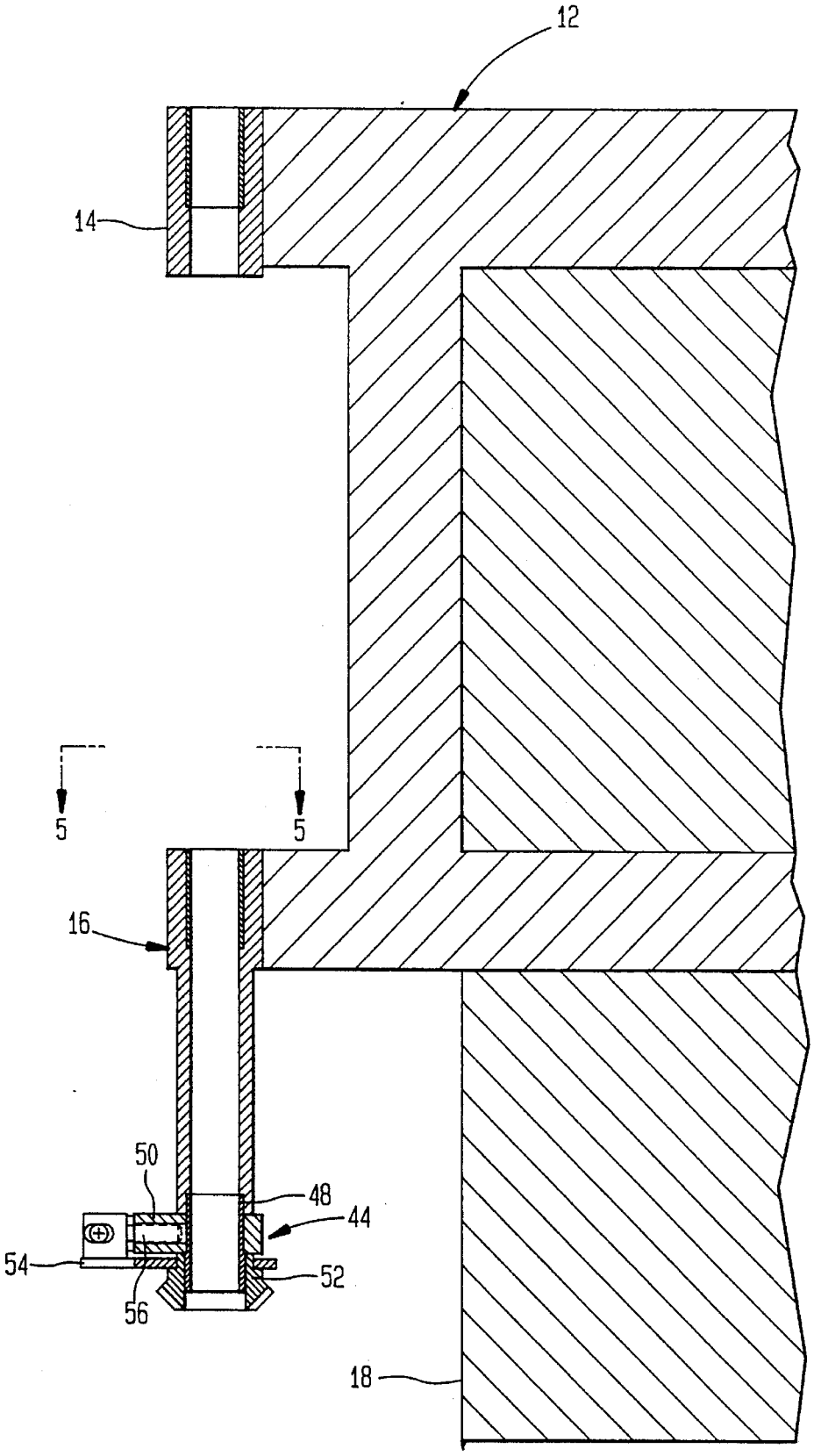
FIG. 4 depicts the gate of FIG. 3 having upper and lower hinges, wherein a bevel gear is coupled to the lower hinge by means of a centering plate, a hinge extension disposed perpendicular to the base of the lower hinge, and threaded extension screw disposed within the hinge extension.

Referring to FIG. 4, lower hinge 16 is much longer than upper hinge 14 and has an L-shaped base or extension portion 50 at its lower end which is mounted about a bushing 48. Centering assembly 44 is attached to L-shaped base portion 50 of lower hinge 16, and a first bevel gear 52 is connected to centering assembly 44 such that first bevel gear 52 aligns with the general longitudinal direction of lower hinge 16. The centering assembly 44 allows swing gate 12 to be easily adjusted to center at its closed position. First bevel gear 52, which is a part of coupling assembly 42, couples swing gate 12 to controller assembly 40 as shown in FIG. 3.

Figure 5:
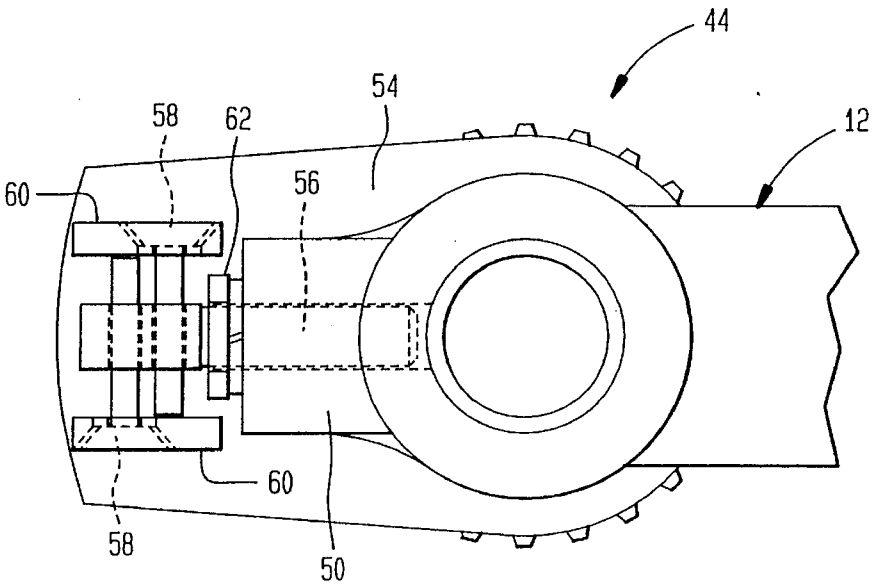
FIG. 5 is a top plan view along line 5—5 of FIG. 4, wherein the relationship between the hinge extension, the threaded extension screw, the centering plate and the pair of centering alignment screws which connect the centering plate to the threaded extension screw is depicted.

Referring to FIGS. 4 and 5, centering assembly 44 of the preferred embodiment includes an adjustable centering plate 54 and a threaded extension screw 56 positioned above centering plate 54. A front end portion of threaded extension 56 extends into L-shaped base portion 50 of lower hinge 16, a back end portion includes a pair of alignment screws 58 supported by retaining blocks 60, and a jam nut 62 is positioned about threaded extension screw 56 therebetween. The two centering or alignment screws 58 are positioned opposite each other and through threaded extension screw 56 to provide centering of swing gate 12 at its closed position.

Figure 6:
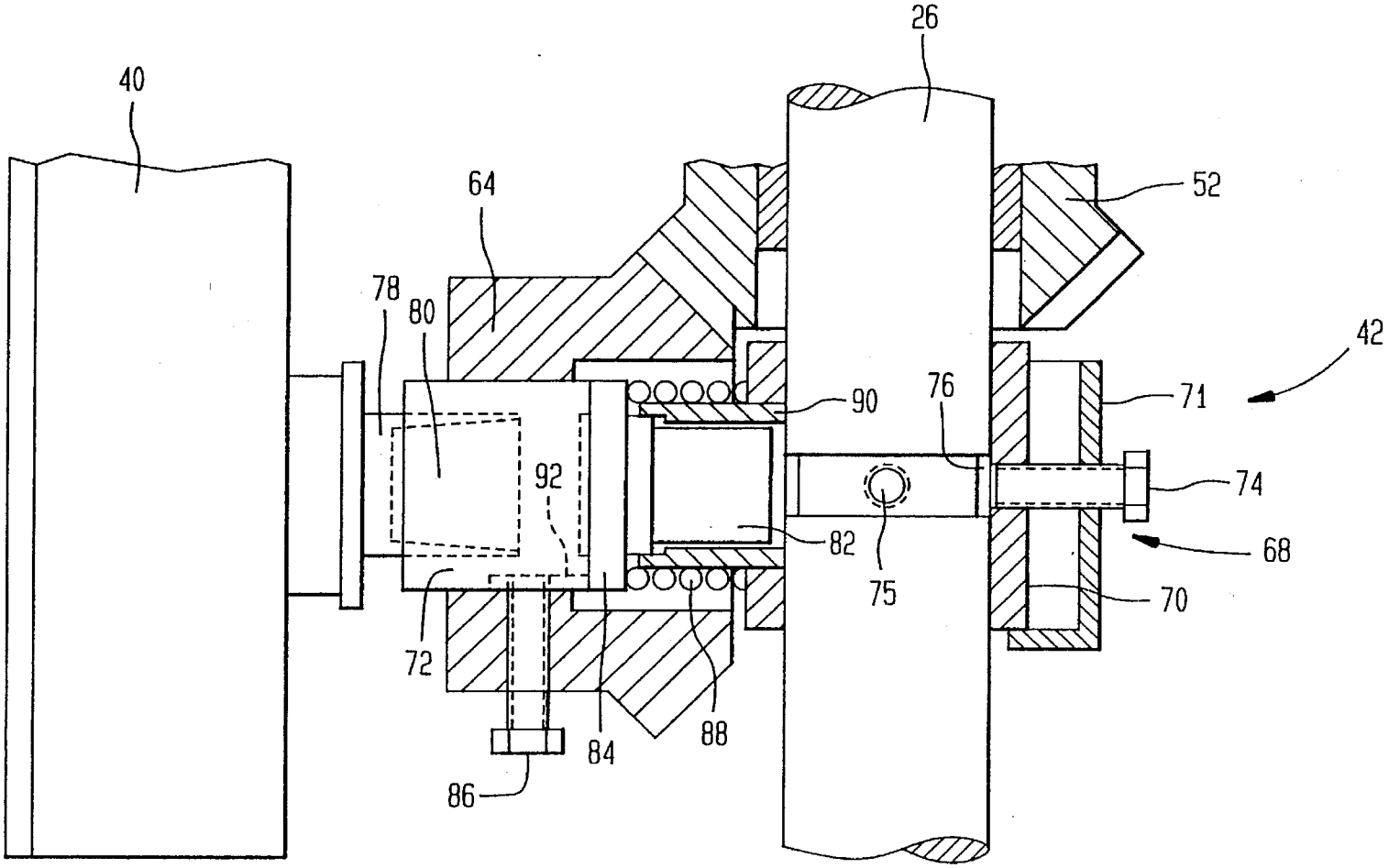
FIG. 6 is an enlarged view of a portion of FIG. 3 depicting the drive shaft of the controller assembly being coupled to a pair of meshed bevel gears by means of a stub shaft disposed about the stationary support shaft.

Referring to FIG. 6, coupling assembly 42 of the preferred embodiment includes first bevel gear 52, a second bevel gear 64 and stub shaft 72. First bevel gear 52 rotates with lower hinge 16 about stationary support shaft 26 whereas second bevel gear 64 is affixed to and rotates with stub shaft 72 laterally from stationary support shaft 26 such that they are positioned perpendicular to each other. Also, first and second bevel gears 52, 64 are comparable in size and, thus, have, for example, a 1:1 ratio of rotation.

Locating means 68, allows adjustment of a support collar 70 which provides in line support for stub shaft 72 about support shaft 26, and is disposed substantially near the meeting point of first and second bevel gears 52, 64. Locating means 68 includes a support collar 70, bracket 71 and adjusting screw 74. By tightening or loosening screw 74, the tension on spring 88 of stub shaft 72 can be readily adjusted. Support collar 70 also provides for inline support of a stub shaft 72 and allows stub shaft 72 to rotate together with controller assembly 40. Also, screws 75 disposed within a sidewall of support collar 70 are directed towards a circumferential groove 76 about the outer surface of support shaft 26. Thus, the screw adjustment 74 also aligns support collar 70 with support shaft 26.

For the preferred embodiment, stub shaft 72 couples second bevel gear 64 to drive shaft 78 of controller assembly 40. Stub shaft 72 comprises a female receptacle 80 which is capable of receiving drive shaft 78 therein and a cylindrical extension 82 which is supported in a radial bearing mounted within the support collar 70 disposed between female receptacle 80 and stationary support shaft 26.

For the preferred embodiment, stub shaft 72 is held within second bevel gear 64 by drive shaft 78 of controller assembly 40 retaining screws 86, a coiled spring 88, thrust bearing 84, and a sintered bronze bearing 90. Retaining screws 86 extend through second bevel gear 64 and enter grooves 92 along the outer wall of stub shaft 72, thus locking stub shaft 72 within second bevel gear 64. Drive shaft 78 of controller assembly 40 mates with female receptacle 80 of stub shaft 72. Bronze bearing 90 which is mounted at one end in support collar 70 allows stub shaft 72 to rotate therein. Further, coiled spring 88 is compressed between thrust bearing 84 and support collar 70 thus axially loading stub shaft 72 against drive shaft 78. Accordingly, there is a solid, continuous connection between drive shaft 78 of controller assembly 40 and stub shaft 72.

Figure 7:
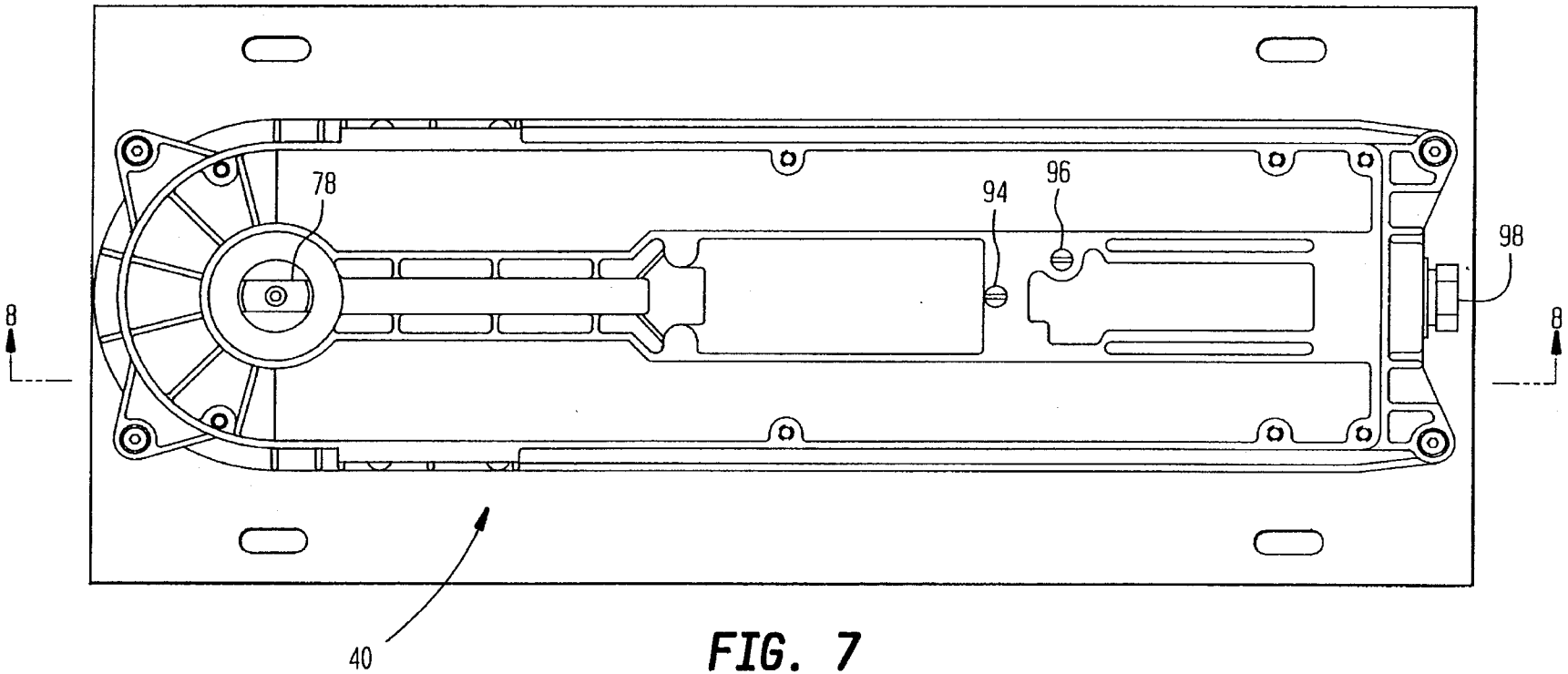
FIG. 7 is a top plan view along line 7—7 of FIG. 3 which shows the controller assembly.
Figure 8:
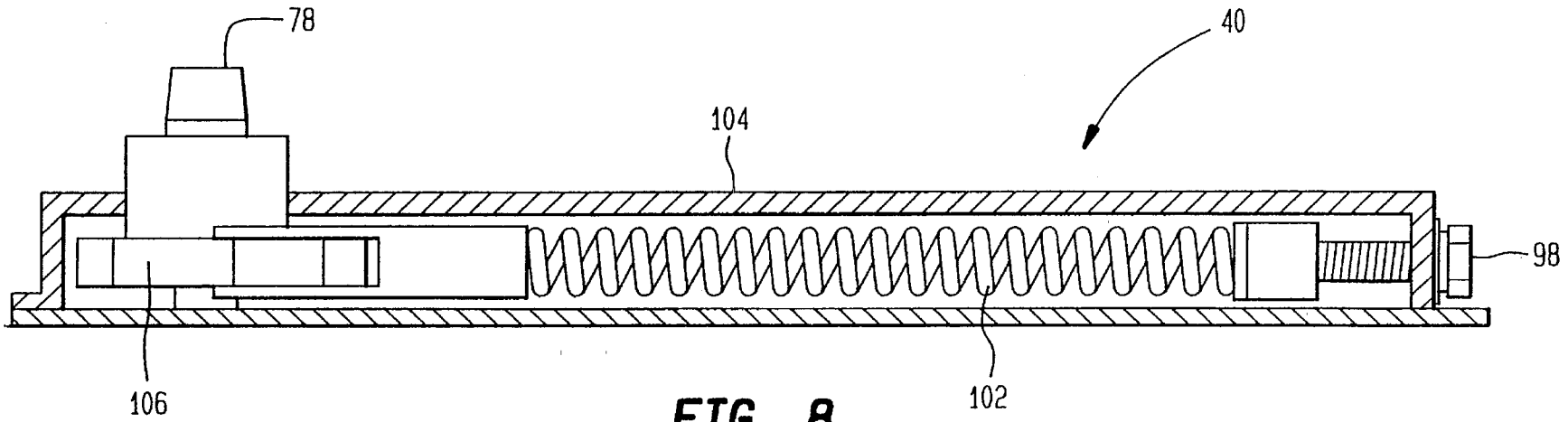
FIG. 8 is a cross-sectional view along line 8—8 of FIG. 7 which shows the inner compartment of the controller assembly.

Referring to FIGS. 7 and 8, controller assembly 40 controls drive shaft 78 such that the rotation of drive shaft 78, when coupled to swing gate 12 (shown in FIG. 1 ), will guide the leading edge of swing gate 20 from an open position of 70 degrees to a point 3 inches (75 mm) from its closed position in 3 seconds or more. In addition, controller assembly 40 must permit swing gate 12 to be pushed or pulled open by a force no greater than 5 lbs. (22.2 N). One example of such controller assembly is the Dor-O-Matic, model 3200 double acting door control, which is available from Dor-O-Matic in Harwood Heights, Ill.

Controller assembly 40 includes two coupled compression springs 102, located along the length of controller housing 104, and equally disposed about the center line of assembly 40. As drive shaft 78 is rotated from the home position, a bi-directional cam 106 mounted on drive shaft 78, compresses coupled springs (102), thus providing the stored energy necessary to return drive shaft 78 to the home position. Bi-directional cam 106 abuts the adjacent ends of coupled springs 102. As bi-directional cam 106 is rotated and protrudes further in the direction of coupled springs 102, the ends of coupled springs 102 slide along the edge of cam 106 and are thus compressed. The preloading of coupled springs (102) can be set by means of an adjusting knob 98 acting upon the free end of coupled compression springs (102).

In addition, "heart shaped" cam 106 located on drive shaft 78 controls a spring loaded piston (not shown) that operates within a linear cylinder (not shown), located along the center line of controller assembly 40. When drive shaft 78 is in the home position, the peak of cam 106 creates maximum compression of the linear cylinder. The controller body is approximately 60% oil filled and sealed.

Thus, as drive shaft 78 is rotated away from the home position, coupled springs 102 are compressed, and the spring loaded piston (not shown) follows cam 106. When drive shaft 78 is fully rotated (i.e., through approximately 90°), coupled springs 102 are fully compressed, and the linear cylinder (not shown) is fully released. As the drive shaft is returned to the home position by the restoring action of coupled compression springs 102, the rate of return is controlled by the compression of the oil filled linear cylinder (not shown). The rate of return can be adjusted by first adjustment screw 94 which adjusts the closing speed and second adjustment screw 96 which adjusts the latching speed. Adjustment screws 94 and 96 act upon internal valves within the linear cylinder (not shown).

Controller assembly 40 of the preferred embodiment permits a 105 degree opening swing. Also, controller assembly 40 has adjustable two-speed closing with a mechanical back check and an adjustable spring tension that allows the spindle torque to be adjusted to meet an exact requirement. That is, first adjustment screw 94 adjusts the closing speed, second adjustment screw 96 adjusts the latching speed, and adjustment knob 98 at one end of controller assembly 40 increases and decreases the spring tension. Preferably, controller assembly 40 has a low load spring of 5 lbs. at 36 inches. In addition, hydraulic fluid preferably controls the operation of the controller assembly 40 to assure that no seasonal adjustment is required when temperature differences are severe.

In addition, drive shaft 78 of controller assembly 40 has a tapered shaped to enable it to readily mate with female receptacle 80 of stub shaft 72 (shown in FIG. 6). For the preferred embodiment, drive shaft 78 is in the shape of a tapered wedge.

In summary, as swing gate 20 is opened in either direction, i.e., rotated away from its closed position, first bevel gear 52 which is coupled to lower hinge 16 of swing gate 20 is rotated about stationary support shaft 26, thus rotating second bevel gear 64 an equivalent amount, which in turn operates controller assembly 40. The perpendicular positioning of the bevel gears (52, 64) ensures a secure coupling between coupling assembly 42 and controller assembly 40. Thus, unlike many existing gate assemblies, the coupling between swing gate 20 and controller assembly 40 cannot easily be separated to permit swing gate 20 to open beyond the rotational limits of controller assembly 40. Then, when swing gate 20 is released and permitted to close, controller assembly 40 returns swing gate 20 back to its closed position at a predetermined speed.

What is claimed is:

1. A bi-directional gate assembly which comprises:

a gate which comprises a gate body and at least one hinge; and a support assembly mounted substantially perpendicular to a floor, said support assembly comprising: a housing; a stationary support shaft vertically disposed within said housing; means for rotating said gate about said stationary support shaft; and a controller assembly disposed within said housing above a surface of said floor, said controller assembly being connected to said means for rotating said gate about said stationary support shaft in such a way as to control the degree of rotation of said gate about said stationary support shaft and to cause said gate to return to its closed position at a predetermined speed.

2. The gate assembly according to claim 1, wherein said controller assembly comprises a controller housing and a drive shaft extending from a side of said controller housing.

3. The gate assembly according to claim 2, wherein said controller housing is disposed perpendicular to the surface of said floor.

4. The gate assembly according to claim 2, wherein said controller assembly is coupled to said gate by said drive shaft which is perpendicularly disposed to said controller housing.

5. The gate assembly according to claim 1, wherein said means for rotating said gate about said stationary support shaft comprises: centering plate which is coupled to said hinge and a first bevel gear which is affixed to said centering plate.

6. The gate assembly according to claim 5, wherein said means for rotating said gate about said stationary support shaft further comprises a radial bearing disposed between an inner surface of said hinge and an outer surface of said stationary support shaft.

7. The gate assembly according to claim 5, wherein said means for rotating said gate about said stationary support shaft further comprises a threaded extension screw adjustably disposed within a bottom extension to said hinge.

8. The gate assembly according to claim 7 wherein said centering plate is connected to said threaded extension screw by means of a pair of alignment screws which are capable of centering said gate at its closed position by adjusting an angular position of said gate with respect to the latching mechanism of said gate assembly.

9. The gate assembly according to claim 5, wherein said controller assembly is connected to said means for rotating said gate about said stationary support shaft by means of a stub shaft coupled to said drive shaft of said controller assembly, and a second bevel gear affixed about said stub shaft, wherein said second bevel gear is meshed together with said first bevel gear.

10. The gate assembly according to claim 9 wherein said first bevel gear is disposed parallel to said stationary support shaft and said second bevel gear is disposed perpendicular to said stationary support shaft.

11. The gate assembly according to claim 10, wherein said first bevel gear and said second bevel gear have a 1:1 ratio of rotation.

* * * * *